US006393730B1

(12) United States Patent
Suzuki

(10) Patent No.: US 6,393,730 B1
(45) Date of Patent: May 28, 2002

(54) DRIER, DRIER ASSEMBLY AND DRYING METHOD

(75) Inventor: Akira Suzuki, Tokyo (JP)

(73) Assignee: Daito Seiki Co., Ltd., Tokyo (JP)

( * ) Notice: Subject to any disclaimer, the term of this patent is extended or adjusted under 35 U.S.C. 154(b) by 0 days.

(21) Appl. No.: 09/509,682

(22) PCT Filed: Apr. 20, 1999

(86) PCT No.: PCT/JP99/02102

§ 371 (c)(1),
(2), (4) Date: Jun. 14, 2000

(87) PCT Pub. No.: WO00/06961

PCT Pub. Date: Feb. 10, 2000

(30) Foreign Application Priority Data

Jul. 30, 1998 (JP) ..... 10-247684
Mar. 8, 1999 (JP) ..... 11-103010
Mar. 8, 1999 (JP) ..... 11-103011

(51) Int. Cl.[7] ..... F26B 3/00

(52) U.S. Cl. ..... 34/510; 34/504; 34/269; 34/278; 34/68

(58) Field of Search ..... 34/266, 267, 268, 34/269, 273, 278, 504, 508, 510, 85, 68

(56) References Cited

U.S. PATENT DOCUMENTS 5,261,165 A * 11/1993 Tate ..... 34/68
5,319,861 A * 6/1994 Tate ..... 34/267
5,966,836 A * 10/1999 Valdez, III et al. ..... 34/448

* cited by examiner

*Primary Examiner*—Pamela Wilson
(74) *Attorney, Agent, or Firm*—Armstrong, Westerman & Hattori, LLP

(57) ABSTRACT

The drying assembly includes a drying apparatus with a far-infrared-ray radiator and ultraviolet irradiator. This ultraviolet irradiator is provided in the rear of the drying apparatus and the irradiation amount irradiated from the device is about 300 to about 600 mJs/cm$^2$.

55 Claims, 5 Drawing Sheets

DRIER, DRIER ASSEMBLY AND DRYING METHOD

TECHNICAL FIELD

The present invention relates to a dryer, a dryer assembly and a drying method that are applied for drying a to-be-dried object using far infrared radiation.

BACKGROUND ART

There has conventionally been known a dryer using far infrared radiation. A far infrared radiator used in the dryer is a metal pipe whose outer surface is provided with a far infrared layer, ceramics and the like. In such a dryer, hot air that is heated by a far infrared radiator is circulated in a drying furnace. Such a hot air circulation method has generally been adopted in a drying furnace.

Especially, in a case where a to-be-dried object is a thin film board made from an epoxy resin on which acrylic resin is coated, there have arisen problems that the to-be-dried object is heated to a high temperature and as a result, the resin is burned or the board is deformed when the to-be-dried object is dried using far infrared radiation having the most suitable wavelength for the to-be-dried object. Therefore, a wavelength range of the far infrared radiation has been shifted to the longer wave side from the wavelength corresponding to the maximum absorbance and thereby, a drying time becomes longer and a quality of the product is problematic.

Besides, impurities included in the dusts, a solvent in resin and the like, generated from a to-be-dried object in a drying process, is mixed into hot air. When the hot air containing such materials is circulated in a drying furnace, the materials attach to resist on a print board and cause inconveniences on the drying process. For example, minute sized impurities in the hot air stick to the surface of the resist, which produce a cause for electric short in the wiring. On the other hand, harmful gases and the like generated in a drying process of resin or the like are released into the atmosphere from the drying furnace, which exerts an adverse influence on the environment.

The present invention has been made in order to solve the above problems and can irradiate a to-be-dried object with far infrared radiation having an optimal wavelength in an effective and efficient manner. It is accordingly an object of the present invention to provide a dryer and a drying method that can reduce a time to be required for drying without deformation of a to-be-dried object regardless of a kind and a thickness of the to-be-dried object and can thereby achieve an excellent dried state.

It is another object to provide a dryer and a drying method in which only clean hot air is supplied in a manner such that neither of impurities in dusts, solvent in resin and the like generated from a to-be-dried object in a drying process reaches a surface of a print board or the like, and thereby, drying of precision parts can be effected in a good yield, and in addition, in which special consideration is given to environment so that neither of harmful gas or the like generated in a drying process of resin or the like is released into the air from the drying furnace.

The disclosure of the invention

A dryer comprises:

a far infrared radiator that emits far infrared radiation optimal for drying a to-be-dried object;

a drying chamber in which far infrared radiation emitted by the far infrared radiator is directed to the to-be-dried object to dry the to-be-dried object;

a plenum chamber for preparing a downflow of hot air toward the drying chamber;

a frame to which a plurality of the far infrared radiators are mounted and which is provided with an opening for jetting the hot air that flows down from the plenum chamber toward the drying chamber;

an elevating device for varying a distance between the to-be-dried object and the far infrared radiators;

a hot air closed circulation path for circulating the hot air that is heated up by heat generated from the far infrared radiators; and a control device for controlling a temperature in the drying chamber, an irradiation time of far infrared radiation, a surface temperature of the far infrared radiator and a distance between the far infrared radiator and the to-be-dried object.

A dryer comprises:

a far infrared radiator that emits far infrared radiation optimal for drying a to-be-dried object;

a drying chamber in which far infrared radiation emitted by the far infrared radiator is directed to the to-be-dried object to dry the to-be-dried object;

a plenum chamber for preparing a downflow of hot air toward the drying chamber;

a frame to which a plurality of the far infrared radiators are mounted and which is provided with an opening for jetting the hot air that flows down from the plenum chamber toward the drying chamber;

an elevating device for moving the plenum chamber and the plurality of far infrared radiators, as one body, upward or downward;

a hot air closed circulation path for circulating the hot air that is heated up by heat generated from the far infrared radiators; and a control device for controlling a temperature in the drying chamber, an irradiation time of far infrared radiation, a surface temperature of the far infrared radiator and a distance between the far infrared radiator and the to-be-dried object.

A dryer comprises:

a far infrared radiator that emits far infrared radiation optimal for drying a to-be-dried object;

a drying chamber in which far infrared radiation emitted by the far infrared radiator is directed to the to-be-dried object to dry the to-be-dried object;

a plenum chamber for preparing a downflow of hot air toward the drying chamber;

an enclosure for enclosing the plenum chamber and the far infrared radiator;

a frame to which a plurality of the far infrared radiators are mounted and which is provided with an opening for jetting the hot air that flows down from the plenum chamber toward the drying chamber;

an elevating device for varying a distance between the to-be-dried object and the far infrared radiators;

a hot air closed circulation path for circulating the hot air that is heated up by heat generated from the far infrared radiator; and a control device for controlling a temperature in the drying chamber, an irradiation time of far infrared radiation, a surface temperature of the far infrared radiator and a distance between the far infrared radiator and the to-be-dried object.

A dryer comprises:

a far infrared radiator that emits far infrared radiation optimal for drying a to-be-dried object;

a drying chamber in which far infrared radiation emitted by the far infrared radiator is directed to the to-be-dried object to dry the to-be-dried object;

a reflecting plate disposed on one side of the to-be-dried object and an insulating material disposed on the other side, wherein the reflecting plate is opposed to the far infrared radiator;

an elevating device for varying a distance between the to-be-dried object and the far infrared radiators;

a first exhaust duct for discharging a gasified solvent or the like from the to-be-dried object in the drying chamber to the atmosphere;

a second exhaust duct for discharging hot air that circulates in the drying chamber;

a hot air closed circulation path for circulating the hot air that is heated up by heat generated from the far infrared radiator; and a control device for controlling a temperature in the drying chamber, an irradiation time of far infrared radiation, a surface temperature of the far infrared radiator and a distance between the far infrared radiator and the to-be-dried object.

In the dryer,the far infrared radiator includes: a far infrared radiation layer provided on a surface of a curved metal plate; a heating device for heating the metal plate; and a holding/shaping plate for holding the metal plate in a curved shape and/or making the metal plate assume a curved shape.

In the dryer, the hot air closed circulation path is a closed path through which the hot air circulates from the drying chamber through the plenum chamber again to the drying chamber.

The dryer,further comprises a gas molecule decomposition device that is provided in the hot air closed circulation path for cleaning the hot air that flows down from the plenum chamber.

In the dryer,the gas molecule decomposition device is located between the plenum chamber and the far infrared radiator at a site close to the far infrared radiators.

In the dryer,the gas molecule decomposition device has a radical reaction chamber in the enclosure for removing a gas molecule included in the hot air by a radical reaction.

In the dryer,the gas molecule decomposition device is located at a position downstream from the drying chamber.

The dryer, further comprises: a catalyst device and a filter device in the hot air closed circulation path in addition to the gas molecule decomposition device.

In the dryer,the filter device is provided in the plenum chamber.

In the dryer,the gas molecule decomposition device includes a heating device, a heat exchanger or a heat accumulator.

In the dryer, the heat accumulator has a structure in which a plurality of pipes made of a material with good heat conductivity are arranged at predetermined intervals.

In the dryer, the far infrared radiator emits far infrared radiation from above and below the to-be-dried object.

In the dryer, the far infrared radiator is arranged above or below the to-be-dried object and a reflecting plate that reflects far infrared radiation emitted from the far infrared radiator is disposed below or above the to-be-dried object.

In the dryer, the drying chamber includes an enclosure comprising a reflecting plate disposed on one side of the to-be-dried object and an insulating material disposed on the other side of the to-be-dried object.

In the dryer, an interior of the enclosure constitutes a radical reaction chamber.

The dryer, further comprises: an exhaust path for discharging the hot air that is circulating in the hot air closed circulation path into the atmosphere; and a removal device provided in the exhaust path for preventing impurities in the hot air from being discharged into the atmosphere.

In the dryer, the exhaust path comprises: a first exhaust duct for discharging a gasified solvent or the like from the to-be-dried object in the drying chamber into the atmosphere; and a second exhaust duct for discharging the hot air that is circulating in the drying chamber to the atmosphere.

In the dryer, a surface temperature of the to-be-dried object is set to a predetermined temperature through control by the control device of at least one of the parameters including a temperature in the drying chamber, a surface temperature of the far infrared radiator, an irradiation time of far infrared radiation and distance between the far infrared radiator and the to-be-dried object.

In the dryer, the control device controls at least one of parameters including a temperature in a drying chamber, a surface temperature of the far infrared radiator, an irradiation time of far infrared radiation and a distance between the far infrared radiator and the to-be-dried object so that no deformation of the to-be-dried object occurs.

In the dryer, the to-be-dried object includes a thin board made of acrylic resin and a surface temperature of the board is set in the range of from about 50° C. to about 90° C.

In the dryer, the to-be-dried object includes a thin board made of polycarbonate resin and a surface temperature of the board is set in the range of from about 70° C. to about 75° C.

In the dryer, the to-be-dried object includes a thin board made of epoxy resin and a surface temperature of the board is set in the range of from about 120° C. to about 145° C.

In the dryer, the to-be-dried object includes a thin board made of aluminum and a surface temperature of the board is set in the range of from about 100° C. to about 175° C.

The dryer assembly comprises a plurality of the dryers, each as a unit, parameters in each dryer including a temperature in a drying chamber, an irradiation time of far infrared radiation, a surface temperature of the far infrared radiator and a distance between the far infrared radiator and the to-be-dried object are independently controlled.

In the dryer assembly ,in at least one of the parameters in each dryer including a temperature in a drying chamber, an irradiation time of far infrared radiation, a surface temperature of the far infrared radiator and a distance between the far infrared radiators and the to-be-dried object is differently set from the other dryers.

In the dryer assembly ,a temperature in a drying chamber is set to the lowest on the inlet side of the to-be-dried objects in a dryer.

In the dryer assembly, the dryer uses insulating material for a frame.

The dryer assembly comprises an ultraviolet radiator for irradiating the to-be-dried object with ultraviolet after the to-be-dried object is irradiated with far infrared radiation from the far infrared radiator.

In the dryer assembly,an irradiation dose of ultraviolet emitted from the ultraviolet radiator is in the range of from about 300 to about 600 mJ/cm$^2$.

The dryer assembly comprises an ultraviolet radiator for irradiating each to-be-dried object with ultraviolet before the to-be-dried object is irradiated with far infrared radiation from the far infrared radiator.

The dryer assembly comprising a plurality of the dryer comprises a microwave radiator for irradiating the to-be-dried object with microwave before the to-be-dried object is irradiated with far infrared radiation from the far infrared radiator.

The dryer assembly further comprises transport means for transporting the to-be-dried object between the plurality of dryers, between the dryer and the ultraviolet radiator, or between the dryer and the microwave radiator.

In the dryer assembly, transport means is provide d with transmission means for transmitting a microwave, far infrared radiation and ultraviolet.

A drying method comprises:

a step of changing a wavelength range of far infrared radiation in order to supply far infrared radiation optimal for drying a to-be-dried object by changing a surface temperature of a metal plate from which the far infrared radiation is emitted;

a step of setting a surface temperature for setting a surface temperature of the to-be-dried object to a predetermined temperature by controlling a distance between a far infrared radiator and the to-be-dried object;

a step of irradiating the to-be-dried object with far infrared radiation of the predetermined wavelength from the far infrared radiator; and a step of supplying hot air heated up by using heat generated from the far infrared radiator to the to-be-dried object through a hot air closed circulation path.

A drying method comprises:

a step of changing a wavelength range of far infrared radiation in order to supply far infrared radiation optimal for drying a to-be-dried object by changing a surface temperature of a metal plate from which the far infrared radiation is emitted;

a step of setting a surface temperature for setting a surface temperature of the to-be-dried object to a predetermined temperature by controlling a distance between a far infrared radiator and the to-be-dried object;

a step of irradiating the to-be-dried object with far infrared radiation of the predetermined wavelength from the far infrared radiator;

a step of supplying hot air heated up by using heat generated from the far infrared radiator to the to-be-dried object through a hot air closed circulation path; and a step of irradiating the to-be-dried object with ultraviolet after the to-be-dried object is irradiated with far infrared radiation.

In the drying method ,an irradiation dose of ultraviolet emitted from the ultraviolet radiator is in the range of from about 300 to about 600 mJ/cm$^2$.

A drying method comprises:

a step of irradiating a to-be-dried object with ultraviolet;

a step of changing a wavelength range of far infrared radiation in order to supply far infrared radiation optimal for drying the to-be-dried object by changing a surface temperature of a metal plate from which the far infrared radiation is emitted;

a step of setting a surface temperature for setting a surface temperature of the to-be-dried object to a predetermined temperature by controlling a distance between a far infrared radiator and the to-be-dried object;

a step of irradiating the to-be-dried object with far infrared radiation of the predetermined wavelength from the far infrared radiator; and a step of supplying hot air heated up by using heat generated from the far infrared radiator to the to-be-dried object through a hot air closed circulation path.

A drying method comprises:

a step of irradiating the to-be-dried object with a microwave;

a step of changing a wavelength range of far infrared radiation in order to supply far infrared radiation optimal for drying a to-be-dried object by changing a surface temperature of a metal plate from which the far infrared radiation is emitted;

a step of setting a surface temperature for setting a surface temperature of the to-be-dried object to a predetermined temperature by controlling a distance between a far infrared radiator and the to-be-dried object;

a step of irradiating the to-be-dried object with far infrared radiation of the predetermined wavelength from the far infrared radiator; and a step of supplying hot air heated up by using heat generated from the far infrared radiator to the to-be-dried object through a hot air closed circulation path.

A drying method comprises:

a step of changing a wavelength range of far infrared radiation in order to supply far infrared radiation optimal for drying a to-be-dried object by changing a surface temperature of a metal plate from which the far infrared radiation is emitted;

a step of setting a surface temperature for setting a surface temperature of the to-be-dried object to a predetermined temperature by controlling a distance between a far infrared radiator and the to-be-dried object;

a step of supplying hot air heated up by using heat generated from the far infrared radiator to the to-be-dried object through a hot air closed circulation path;

a step of irradiating the to-be-dried object with far infrared radiation of the predetermined wavelength from the far infrared radiator; and a step of supplying hot air heated up by using heat produced from the far infrared radiator after cleaning the hot air to the to-be-dried object through a hot air closed circulation path. 43. In the drying method according to any of claims 37, 38, 40, 41or 42, the hot air supplied to the to-be-dried object is prepared from a plenum state as a downflow.

In the drying method,the far infrared radiation of a wavelength in the range of from about 3 $\mu$m to about 6 $\mu$m corresponding to the maximum absorbance inherent to the to-be-dried object is selected in the step of changing the wavelength range of far infrared radiation.

The drying method, further comprises a step of cleaning for causing a radical reaction by gas decomposition of impurities in the hot air that circulates in the hot air closed circulation path.

BEST MODE TO CARRY OUT THE INVENTION

A to-be-dried body comprises: a metal plate made of a metal such as aluminum or a synthetic resin board made of synthetic resin such as acrylic resin, epoxy resin and polycarbonate resin; a synthetic resin layer coated thereon made of a resin such as phenol resin, epoxy resin and urethane resin; copper paste; silver paste; solder; and so on. Further, the to-be-dried object may be constituted of food, wood and the like as well. First and second embodiments described below illustrate cases where to-be-dried-objects such as print boards made of epoxy resin on which resists containing acrylic resin, epoxy resin and the like are coated are dried, but the present invention is not limited to drying of such to-be-dried objects.

In general, a wavelength and a surface temperature of a far infrared radiator have a relationship therebetween and a surface temperature of a to-be-dried object varies according to a distance between the far infrared radiator and the to-be-dried object.

Figure 1:
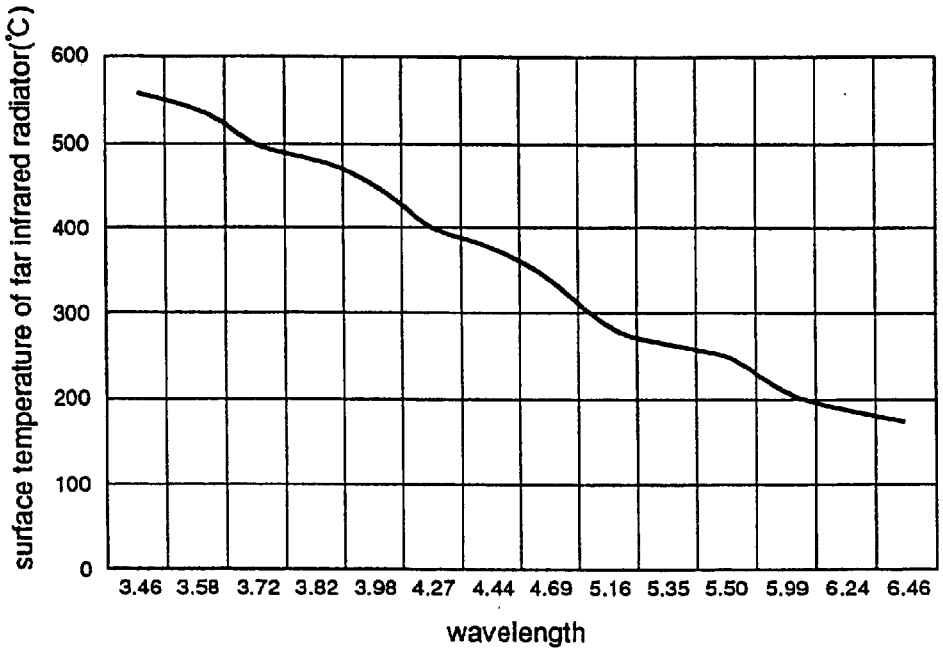
FIG. 1 is a graph showing a relationship between a surface temperature of a to-be-dried object with a distance between the to-be-dried object and a far infrared radiator.

FIG. 1 shows a relationship between a wavelength and a surface temperature of a to-be-dried object. As shown in FIG. 1, as a wavelength is shorter, the surface temperature of the far infrared radiator is higher. That is, according to the Figure, a surface temperature of the far infrared radiator is ranged from about 540° C. to about 170° C. in the range of from 3.58 to 6.46 $\mu$m in wavelength.

Figure 2:
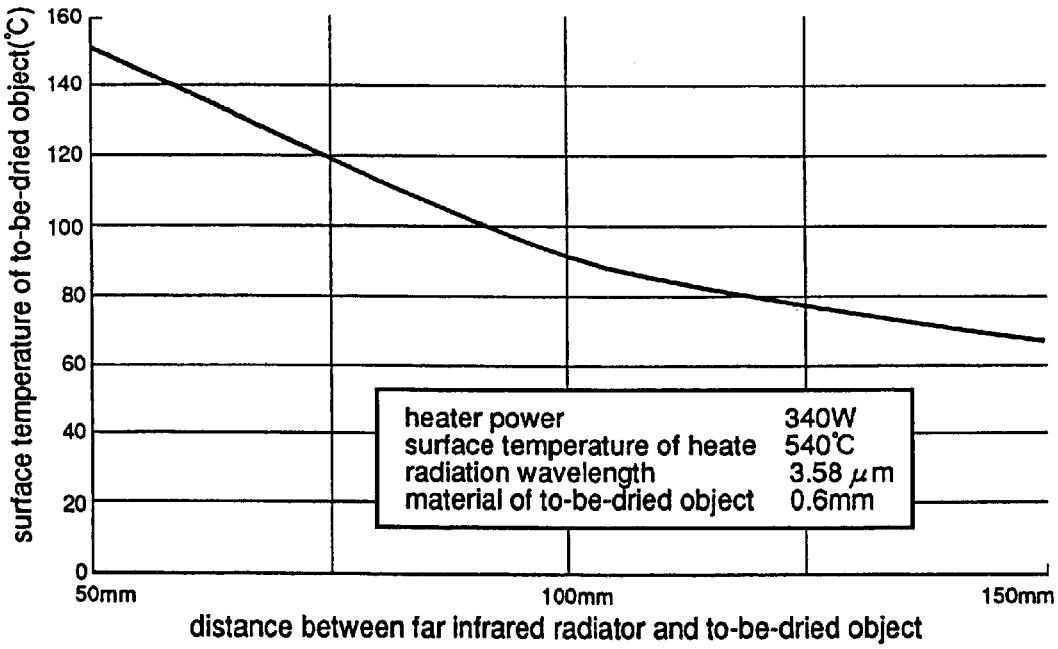
FIG. 2 is a graph showing a relationship between a surface temperature of a to-be-dried object with a radiation wavelength of a far infrared radiator.

FIG. 2 shows a surface temperature of a to-be-dried object obtained by changing a distance between a far infrared radiator and a to-be-dried object using the far infrared radiator whose output is 340 watt, surface temperature is 540° C. and wavelength is 3.58 $\mu$m. In this case, the to-be-dried body in use was a aluminum plate of 0.6 mm thickness. According to the Figure, surface temperatures of the to-be-dried object are ranged from about 150° C. to about 70° C. at distances ranged from 50 to 150 mm.

In such a way, a far infrared radiation wavelength range for emitting a far infrared radiation which is optimal for, drying a to-be-dried object is set while changing a surface temperature of a metal plate from which a far infrared radiation is emitted. The surface temperature of the to-be-dried object is set to a predetermined temperature by controlling the distance between the far infrared radiator and the to-be-dried object. After that, a far infrared radiation of the set wavelength is emitted from the far infrared radiator to the to-be-dried object. Hot air created by using a heat generated from the far infrared radiator is supplied to the to-be-dried object through a closed circulation path for hot air.

Figure 3:
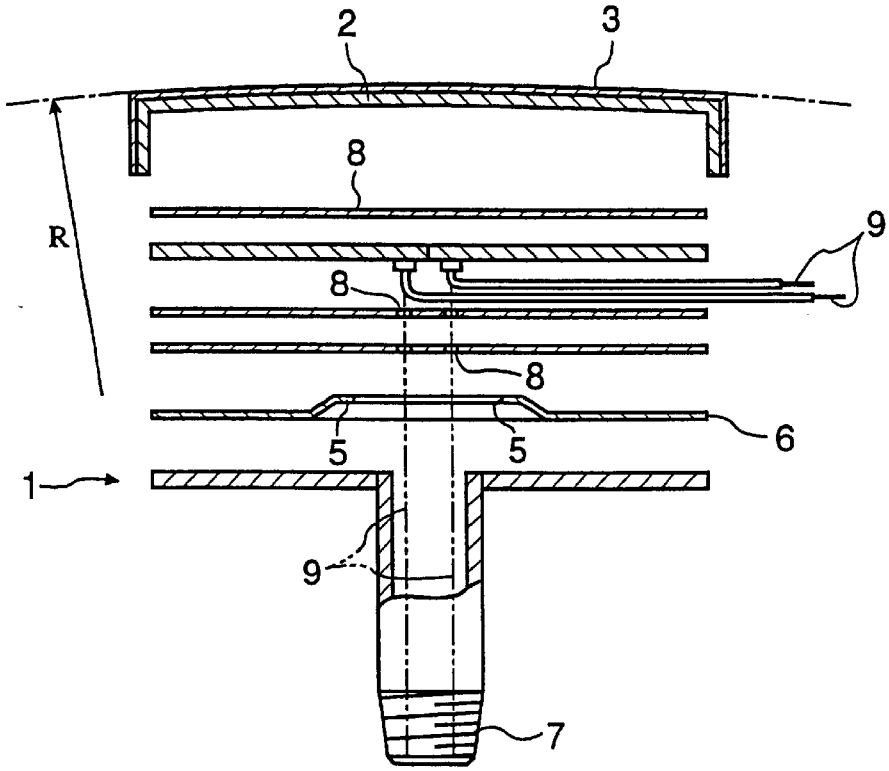
FIG. 3 is a schematic sectional view of a far infrared radiator.

In the far infrared radiator 1 used here, as shown in FIG. 3, a far infrared radiation layer 3 is provided on a metal plate 2 such as aluminum or stainless steel of arcuate shape with a convex of a predetermined curvature R and the metal plate 2 is heated to a predetermined temperature with a heating device 4 such as a coil. Setting of temperature of the far infrared radiator is adjustable at three levels. The far infrared radiator emits far infrared radiation of a wavelength ranged from about 3 $\mu$m to about 6 $\mu$m that corresponds to the maximum absorbance of a resin material that is coated on a board of the to-be-dried object. Further, a holding/shaping plate 6 having a holding/shaping portion 5 is combined with the metal plate 2 in order that the metal plate 2 holds its shape without deformation to be caused by heat and/or assumes a predetermined shape.

Further, insulating plates 8 are respectively provided between the coil 4 and the metal plate 2, and between the coil 4 and the holding/shaping plate 6. Reference numeral 7 indicates a socket and reference numeral 9 indicates a lead wire.

First Embodiment

Figure 4:
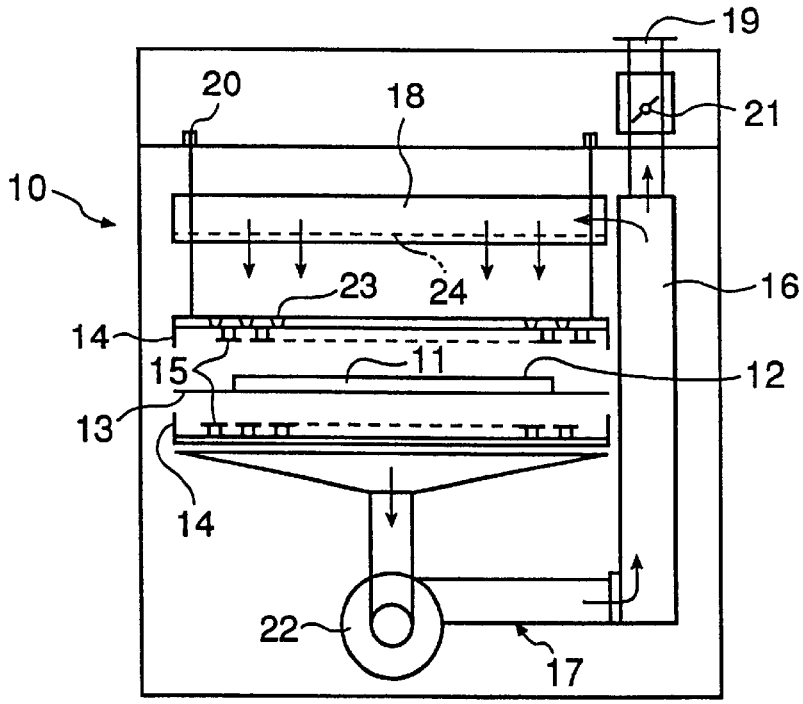
FIG. 4 is a front view showing a dryer of an embodiment according to the present invention.

FIG. 4 is a front view showing a dryer of an embodiment according to the present invention. A dryer 10 of the embodiment, as described in the Figure, comprises: a drying chamber 12 for drying a to-be-dried object 11; a transport belt 13 that is provided in the drying chamber 12 while extending in a longitudinal direction for transportation of the to-be-dried object 11 and which forms a planar transport path; frames 14 made of stainless steel, disposed above and below the transport belt 13; a plurality of far infrared radiators 15 arranged between the frames 14 in a staggered manner; a hot air closed circulation path 17 for supplying hot air including the heat generated from the far infrared radiators 15 to the drying chamber 12 through a circulation path 16; a plenum chamber 18 for preparing a downflow of the hot air introduced from the circulation path 16 toward the drying chamber 12; and an exhaust path 19 for discharging part of the hot air into the atmosphere. Herein, the frames 14 of the dryer 10 are made from heat insulating material.

The far infrared radiators 15 disposed below the transport belt 13 may be replaced with a stainless steel reflecting plate. Further, a far infrared radiation layer that emits far infrared radiation is preferably provided on the reflecting plate. Still further, it is acceptable that a stainless steel reflecting plate is disposed instead of the far infrared radiators 15 arranged above the transport belt 13 and the far infrared radiators 15 are arranged below the transport belt 13.

The hot air is made to flow down toward openings 23 provided in the frame 14 from the plenum chamber 18 and the hot air passing through the openings are jetted into the drying chamber 12. The plenum chamber 18 is connected to the circulation path 16 at one side thereof through a flexible tube. Further, the far infrared radiator has the same structure as that of FIG. 3.

The frames 14 to which the far infrared radiators 15 are mounted and the plenum 18 are fixed to a drive device 20 which serves as elevating means and they, as one body, are movable upward and downward within a range of 10 to 300 mm. By the movement, a distance between the to-be-dried object 11 and the far infrared radiators 15 can be changed. On the other hand, a distance between the frames 14 and the plenum chamber 18 is kept constant.

A temperature in the drying chamber 12 is controlled so as to be a predetermined temperature all time. That is, when a temperature in the drying chamber 12 exceeds the predetermined temperature, an adjusting valve 21 that is provided in the exhaust path 19 is opened. Then part of the hot air which circulates inside the drying chamber 12 is released to the atmosphere, thereby reducing a temperature of the circulating hot air. In this way, a temperature of the hot air generated by the heat of far infrared radiation in the drying chamber 12 is controlled by the adjusting valve 21 and thereby the hot air at a predetermined temperature is supplied into the drying chamber 12 all the time.

The hot air generated from the far infrared radiators 15 is circulated in the dryer from the drying chamber 12 by a circulation blower 22 that is disposed below the drying chamber 12. That is, the hot air is introduced from the drying chamber 12 through the circulation path 16 into the plenum chamber 18 disposed above the drying chamber 12. Then, the hot air is forced to flow down toward the openings 23 provided in the frame 14 from the plenum chamber 18 and further jetted into the drying chamber 12 through the openings 23, thus completing a hot air closed circulation path.

The drying chamber 12 is constituted of a space in which the to-be-dried object is accommodated. The drying chamber 12 may further be connected to an inert gas supply apparatus (not shown). That is, an inert gas, for example, nitrogen gas, may be introduced into the hot air. By introducing nitrogen gas into the drying chamber 12, oxidation of a resin of the to-be-dried object can be reduced during a drying process and thereby, re-oxidation of the resin is prevented from occurring. Hence, a film quality of the dried resin can be improved. Further, a solvent generated from the resin is mixed with nitrogen gas and completely discharged from the drying chamber.

Second Embodiment

Figure 5:
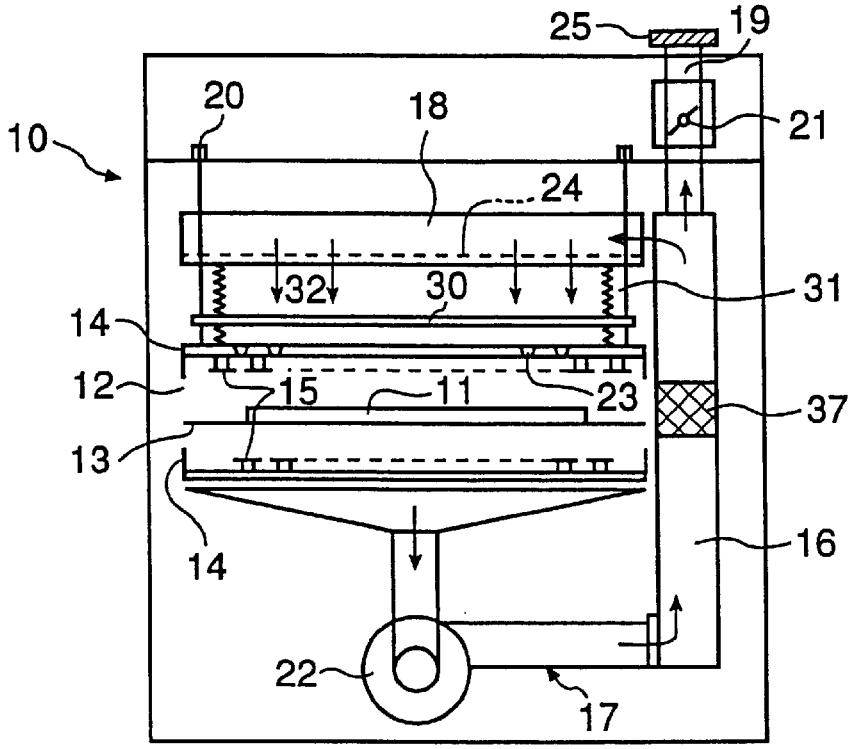
FIG. 5 is a front view showing a dryer of another embodiment according to the present invention.

FIG. 5 is a front view showing a dryer of another embodiment according to the present invention. A dryer 10 of the embodiment, as described in the Figure, comprises: a drying chamber 12 for drying a to-be-dried object 11; a transport belt 13 that is provided in the drying chamber 12 while extending in a longitudinal direction for transportation of the to-be-dried object 11 and which forms a planar transport path; frames 14 made of stainless steel, disposed above and below transport means; a plurality of far infrared radiators 15 arranged in the frames 14 in a staggered manner; a gas molecule decomposition device 30 as a hot air cleaning device disposed above the frames 14, for example a heat accumulator; a hot air closed circulation path 17 for supplying hot air including the heat generated from the far infrared radiator 15 to the drying chamber 12 through a circulation path 16; a plenum chamber 18 for preparing a downflow of the hot air introduced from the circulation path 16 toward the drying chamber 12; and an exhaust path 19 for discharging part of the hot air to the atmosphere. Herein, the frames 14 of the dryer 10 are made from heat insulating material.

The far infrared radiators 15 disposed below the transport belt 13 may be replaced with a stainless steel reflecting plate. Further, a far infrared radiation layer that emits far infrared radiation is preferably provided on the reflecting plate. Still further, it is acceptable that a stainless steel reflecting plate is disposed instead of the far infrared radiators 15 arranged above the transport belt 13 and the far infrared radiators 15 are arranged below the transport belt 13.

The hot air is made to flow down toward openings 23 provided in the frame 14 from the plenum chamber 18 and the hot air passing through the openings are jetted into the drying chamber 12. The plenum chamber 18 is connected to the circulation path 16 at one side thereof through a flexible tube. The far infrared radiator has the same structure as that of FIG. 3. The hot air closed circulation path 17 is a closed circuit in which the hot air circulates from the drying chamber 12 through the plenum chamber 18 again to the drying chamber 12.

The frames 14 to which the far infrared radiators 15 are mounted and the heat accumulator 30 and the plenum chamber 18 are fixed to a drive device 20 which serves as elevating means, which can be moved upward and downward within a range of 10 to 300 mm by elevating means. By the movement, a distance between the to-be-dried object 11 and the far infrared radiators 15 can be changed. On the other hand, distances between the frames 14, the heat accumulator 30 and the plenum chamber 18 are kept constant.

Figure 6:
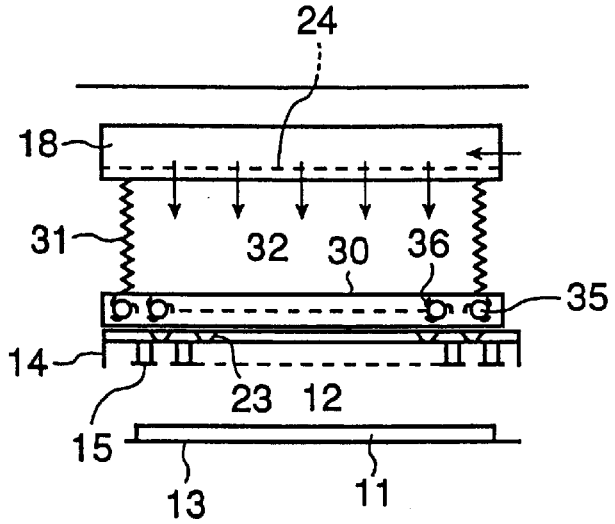
FIG. 6 is a schematic view showing a main portion of a dryer equipped with a heat accumulator according to the present invention.

FIG. 6 is a schematic view showing a main portion of a dryer equipped with a heat accumulator. The heat accumulator 30 has a structure in which a plurality of pipes 35 made from copper with a good thermal efficiency are fixedly arranged on the frame 14 at predetermined pitches. Radiation fins 36 are fast held on the surface of each pipe 35. In this case, the heat accumulator 30 is heated up to about 400° C. Therefore, the hot air is heated up when it passes through the heat accumulator 30.

The hot air cleaning device may be disposed anywhere in the hot air closed circulation path 17. The hot gas cleaning device comprises the gas molecule decomposition device 30. The molecule decomposition device heats up the hot air including impurities, mist and carbon-like materials to about 400° C. to decompose gas molecules through oxidation. In this way, the impurities and the like in the hot air supplied to the to-be-dried object are removed and the cleaned hot air is eventually supplied.

The gas molecule decomposition device can assume various kinds of structure. In the present invention, in order to effectively utilize the heat produced by the far infrared radiators 15, the plurality of copper pipes 35 with a good heat conductivity are arranged at predetermined intervals. Further, fins are provided on each of the copper pipes 35 in order to increase a thermal efficiency. The copper pipes 35 are heated up to about 400° C. through heat accumulation by the heat. It is preferred in terms of a heat accumulation effect that this decomposition device 30 is located at a site as close to the far infrared radiators 15 as possible.

Further, the dryer 10 is provided with a radical reaction chamber 32. An enclosure 31 that is extendable and contractable and which is made from a heat resistant material is disposed between the frame 14 and the plenum chamber 18. A space that is formed by the enclosure 31 constitutes the radical reaction chamber 32. The radical reaction chamber 32 is provided with a heating device or a heat accumulator. Impurities in the resin in the hot air, mist and carbon-like materials included are decomposed by the action of free radical reactions caused by the heat when the impurities and the others pass through the heating device or the heat accumulator.

In this way, the radical reaction chamber 32 decomposes various kinds of materials included in the resin, which are generated in a drying process of the resin and impurities mist and carbon-like materials included in the hot air which is supplied toward the drying chamber 12 from the plenum chamber 18 in a uniform manner are decomposed. Hence, the radical reaction chamber 32 repeatedly decomposes the materials such as the impurities and thereby the hot air that is introduced into the drying chamber 12 from the radical reaction chamber 32 becomes clean without any such materials included therein.

In description in more detailed manner, dust, mist and impurities remaining in the hot air guided into the plenum chamber 18 through the hot air closed circulation path 17 are oxidation-decomposed to be gasified when the impurities and the like pass through the heat accumulator that makes up the radical reaction chamber. Gases that are produced by gasification goes up to the plenum chamber 18. In such a manner, oxidation decomposition of the impurities and the like is repeatedly conducted in the radical reaction chamber 32. Therefore, the hot air supplied to the drying chamber 12 are cleaned free of impurities in mist and dust. Then thus cleaned hot air is jetted to the to-be-dried object 11 in the drying chamber 12 from the openings 23 provided in the frame 14. The plenum chamber 18 may be provided with a filter 24 for cleaning the hot air.

It should be noted that the heat accumulator 30 is not limited to the structure as shown in the Figure but can be of other structures. Further, a heating device may be substituted for the heat accumulator 30. A temperature of the heating device is raised to about 400° C.

Besides, the hot air including a solvent in the resin and impurities in mist and dust generated in the course of drying of the to-be-dried object flows from the drying chamber 12 to the circulation path 16. Then, the impurities and the like included in the hot air are removed when the impurities and the like pass through a catalyst device 37 provided in the circulation path 16, for example a catalytic layer having a catalyst that adsorbs a solvent in the resin, and impurities in mist and dust. Therefore, the impurities and the like included in the hot air that has passed through the catalyst device 37 are reduced in quantity. Further, the hot air with less impurities reaches the heat accumulator 30, that is the radical reaction chamber 32, through the plenum chamber 18 and during the passage through the chambers, the impurities are further decreased. Further, the hot air passes through the filter 24, thereby decreasing the impurities additionally. As a result, the hot air that has been cleaned free of the impurities is eventually supplied to the drying chamber 12.

Besides, in the Figure, transport means is provided along the longitudinal direction of the dryer. As the transportation means, generally, a belt conveyor made from a heat resistant rubber is used. When a belt conveyor or the like is used as transport means, various kinds of dust particles are generated from the conveyor itself during the transportation. Hence, there occurs a chance of the dust particles attaching to a to-be-dried object.

Therefore, such a belt cannot be used for a to-be-dried object that does not allow attachment of the particles to itself for an adverse effect. For example, it is not preferred that the belt is used f or drying electronic parts such as a print board. In order to avoid such an inconvenience, a structure is here proposed, in which the transport device employs a plate member extending along a longitudinal direction that emits far infrared radiation and the plate member is provided with many small holes therein. Further, cleaned air is jetted out toward the surface of the to-be-dried object from the small holes. That is, the to-be-dried object is transported in a floating state from a support surface of the transport device with a small clearance therebetween. In such a way, impurities such as various kinds of particles dispersed in the drying chamber 12 and impurities are prevented from attaching to a print board.

Further, in order to avoid release of impurities and harmful gases into the atmosphere when the hot air is discharged into the atmosphere, as described above, a removal device constituted of an absorption layer that absorbs the impurities and harmful materials, for example an active carbon layer 25, may be placed in the exhaust path 19. In this case, since the hot air that are supplied to the exhaust path 19 is considerably hot in temperature, the hot air to be discharged is preferably heat exchanged with a cooling layer provided in the exhaust path 19 in order to decrease a temperature of the hot air by air cooling when the hot gas is discharged.

Third Embodiment

Figure 7:
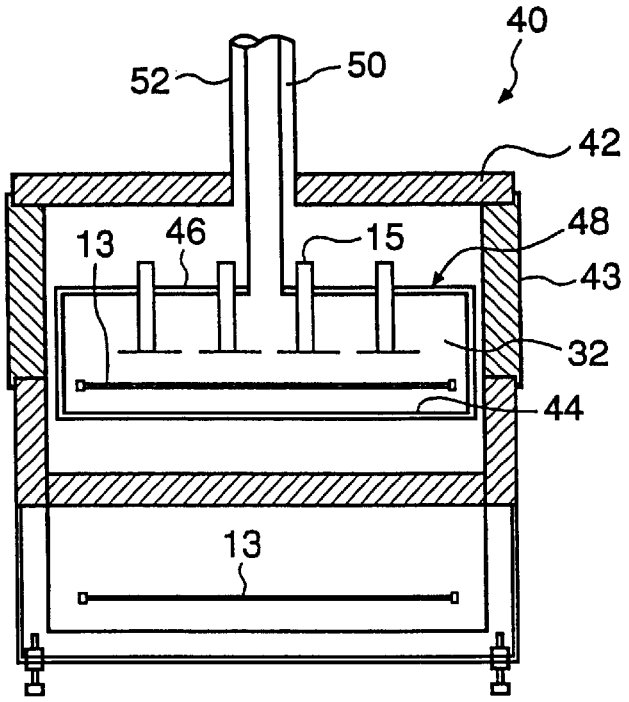
FIG. 7 is a front view showing a dryer of still another embodiment according to the present invention.

FIG. 7 is a front view showing a drier of still another embodiment according to the present invention. In a dryer 40 shown in the Figure, a frame 42 of the dryer 40 is made from a heat insulating material. A portion 43 of a side wall of the frame 42 can be demounted for a maintenance purpose. A drying chamber 32 that is provided in the frame 42 is enclosed by an enclosure 48 provided with a reflecting plate 44 and heat insulating plates 46. It should be noted that the reflecting plate 44 is preferably provided with a far infrared radiation layer which emits far infrared radiation on the side opposed to far infrared radiators 15. The drying chamber 32 is provided with a transport belt 13 for transportation of a to-be-dried object along a longitudinal direction. Far infrared radiation is emitted from a plurality of the far infrared radiators 15 that are arranged above the transport belt 13 toward the to-be-dried object. Air in the drying chamber 32 is heated by heat provided from the far infrared radiators 15 to be hot air and is circulated along the outside of the enclosure 48. It should be noted that a distance between the to-be-dried object and the far infrared radiators 15 can be changed by a elevating device (not shown).

The reflecting plate 44 constituting the enclosure 48 is disposed below the transport belt 13, while the heat insulating plates 46 are disposed above the transport belt 13, and to the left and right sides of the transport belt 13.

The upper heat insulating plate 46 constituting the enclosure 48 is provided with many small holes for introducing the hot air that circulates in the dryer 40 into the drying chamber 32 in the enclosure 48. A gas molecule decomposition device 30 is preferably provided in a hot air circulation path in order to introduce the hot air in circulation from which impurities and the like included therein are removed to be clean into the drying chamber 32. For example, the gas molecule decomposition device 30 is preferably disposed in a space between the heat insulating plate 46 constituting the upper surface of the enclosure 48 and the far infrared radiators 15, or on the heat insulating plate 46. The gas molecule decomposition device 30 is provided with, for example, the heat accumulator as described in a second embodiment. It should be noted that by disposing the gas molecule decomposition device 30 in the enclosure 48 as described above, a radical reaction chamber is formed in the enclosure 48, that is, in the drying chamber 32.

Further, the far infrared radiators 15 can be arranged below the transport belt 13. In this case, the reflecting plate 44 is disposed above the transport belt 13, while the heat insulating plates 46 are respectively disposed above the transport belt 13 and to the left and right sides thereof.

Furthermore, the dryer 40 has a double exhaust duct in the upper frame. The inner exhaust duct 50 of the double exhaust duct is used for discharge of a gasified solvent or the like from a to-be-dried object in the drying chamber to the atmosphere, while the outer exhaust duct 52 is used for discharge of the hot air that circulates in the drying chamber to the atmosphere.

Still furthermore, there is provided in the dryer 40 a hot air circulation path for circulation in the drying chamber of the hot air whose temperature is raised by heat generated from the far infrared radiators. Yet furthermore, there is provided in the dryer 40 a control device for controlling a temperature in the drying chamber, an irradiation time of far infrared radiation, a surface temperature of a far infrared radiator, and a distance between a far infrared radiator and a to-be-dried object.

Fourth Embodiment

Figure 8:
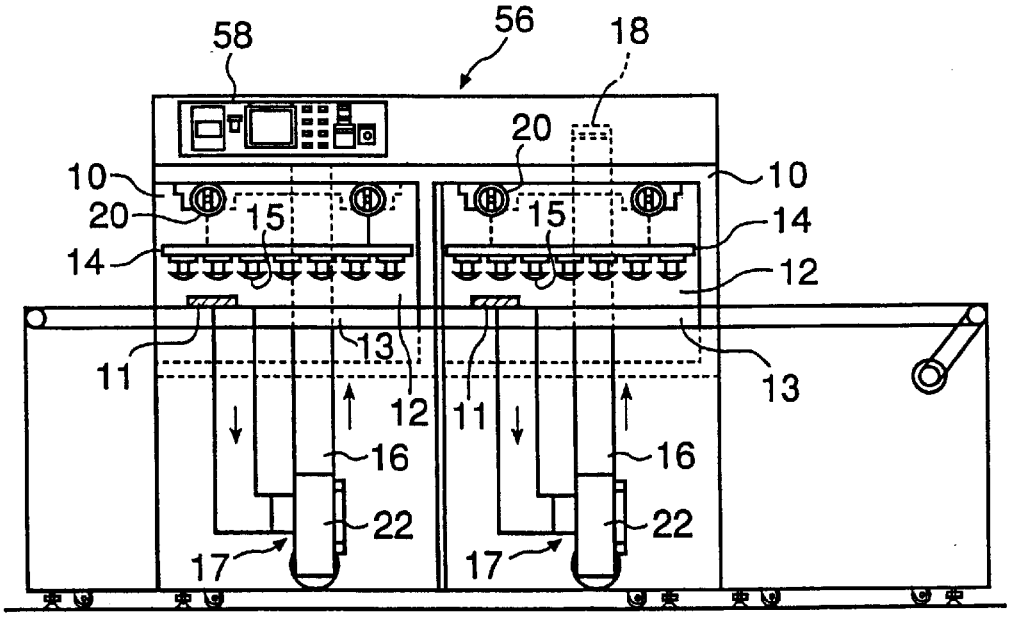
FIG. 8 is a side view showing a dryer assembly according to the present invention.

FIG. 8 is a schematic sectional view showing a dryer assembly 56 according to the present invention that comprises a plurality of dryers described in any of the first to third embodiments. Herein, the same constituents of each of the first to third embodiments are indicated by the same reference numerals.

In the Figure, each dryer uses an insulating material for the frames. A temperature in the drying chamber, an irradiation time of far infrared radiation, a surface temperature of a far infrared radiator, and a distance between a far infrared radiator and a to-be-dried object in each of the dryers are independently controlled.

At least one of the parameters in each of dryers including a temperature in a drying chamber, an irradiation time of far infrared radiation, a surface temperature of a far infrared radiator, and a distance between a far infrared radiator and a to-be-dried object is differently set from the other dryers, or the parameters in the dryers are set to be all same between the dryers. Further, a temperature in the drying chamber is set to the lowest on the transport inlet side.

By setting the parameters in an arbitrarily proper manner in each dryer, drying can be performed in elaborately-selected optimal conditions. Therefore, a dried product with an excellent quality can be attained. The controls of the parameters are performed by a control device 58 equipped to the dryer assembly 56.

Further, control on a voltage or a current of each dryer is effected using a voltage-controlled element or a current-controlled element, thereby enabling power consumption to be reduced.

Fifth Embodiment

Figure 9:
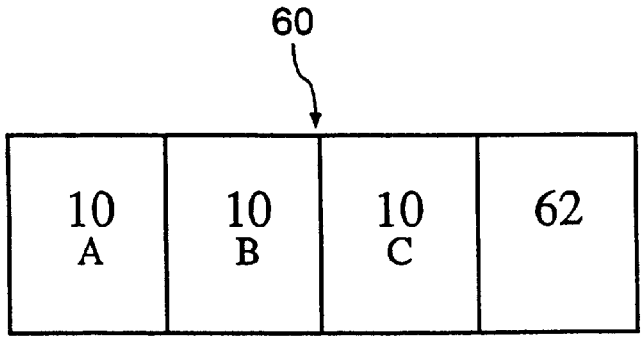
FIG. 9 is a construction illustration showing a dryer assembly of another embodiment according to the present invention.

FIG. 9 is a construction illustration showing a dryer assembly of another embodiment according to the present invention. In the Figure, a dryer assembly 60 comprises: dryers 10A, 10B and 10C; and an ultraviolet radiator 62 provided at a stage following the dryer 10C, which serves in the process after the far infrared irradiation. The dryer assembly 60 uses the dryers respectively described in any of the first to third embodiments. It should be noted that there is no specific limit to three units of the dryer in the dryer assembly but one unit or more than one units may be included.

Table 1 shows setting conditions for the respective dryers that used when to-be-dried objects each of which has a structure in which a resist film including acrylic resin and epoxy resin, 300 $\mu$m thick, is coated on a print board made of epoxy resin are dried, using the dryer assembly 60 with the construction of the Figure, wherein a size of each print board is 620 mm wide and 550 mm long and 1 mm thick.

TABLE 1

| specimen | 10A | 10B | 10C | radiation distance (mm) | irradiation time (sec) |
|---|---|---|---|---|---|
| a print board | surface temperature of radiator (° C.) | | | | |
| (epoxy resin) | 450 | 450 | 450 | 130 | 180 |
| | surface temperature of to-be-dried object (° C.) | | | | |
| | 51 | 53 | 62 | | |

That is, the set conditions were such that: a surface temperature of the far infrared radiators of each dryer was 450° C., a distance between the surface of each set of the far infrared radiators and the board surface of each to-be-dried object (along a vertical direction) was 130 mm, an irradiation time for each dryer was 180 sec and a wavelength of far infrared radiation in use was ranged from 3.98 to 4.63 $\mu$m. Further, in this embodiment, the other conditions were set in the following manner: temperatures of the board of each to-be-dried objects were about 51° C. in the dryer 10A on the inlet side, about 53° C. in the dryer 10B in the middle position and about 62° C. in the dryer 10C on the outlet side. When dried under these conditions, bubbles occurred in the resist coated on each print board and a copper was discolored, which showed that the results were poor.

Therefore, the resists of such defective print boards were irradiated with ultraviolet. Conditions employed for each specimen were that an irradiation time was about 10 sec, and irradiation doses were 100 mJ/cm$^2$, 300 mJ/cm$^2$ and 600 mJ/cm$^2$. Results of ultraviolet irradiation were such that as the doses were applied in the order of 100 mJ/cm$^2$, 300 mJ/cm$^2$ and 600 mJ/cm$^2$, formation of bubbles and copper discoloration were increasingly decreased at levels, wherein an excellent result was obtained especially at the irradiation dose of 600 mJ/cm$^2$. In this ultraviolet irradiation, a wavelength of ultraviolet used was particularly 365 nm in the range of from 100 to 400nm.

Thus, it is found that irradiation of ultraviolet after the far infrared irradiation of resist of a print board is effective for drying the resist on a print board. Further, an irradiation dose of ultraviolet was preferably 100 mJ/cm$^2$ or more and more preferably in the range of from 300 mJ/cm$^2$ to 600 mJ/cm$^2$, where better dry conditions than the former doses were obtained. In such a way, sufficient drying results were obtained by adjustment of the following parameters in each of the dryers 10A, 10B and 10C: a surface temperature of the far infrared radiators, a distance between the surfaces of the far infrared radiators and the to-be-dried object, an irradiation time, whether or not ultraviolet irradiation is applied and an irradiation doses of ultraviolet.

Figure 10:
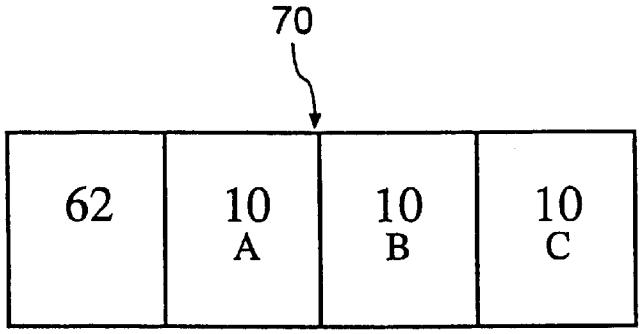
FIG. 10 is a construction illustration showing a dryer assembly of still another embodiment according to the present invention.

Further, FIG. 10 is a construction illustration showing still another dryer assembly according to the present invention. In the Figure, a dryer assembly 70 may comprise: dryers 10A, 10B and 10C; and an ultraviolet radiator 62 that can be provided at a stage preceding the dryer 10A, which can serve in the preceding process of the far infrared irradiation. The dryer assembly 70 uses the dryers described in any of first to third embodiments as the dryers 10A, 10B and 10C.

Figure 11:
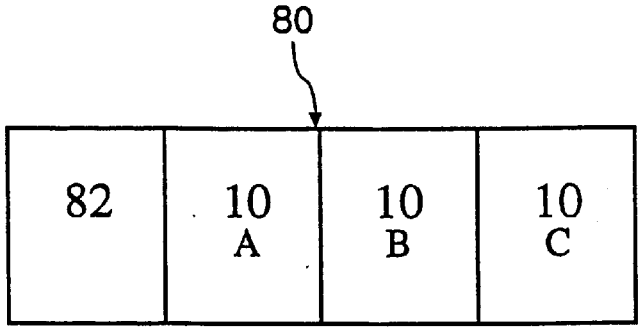
FIG. 11 is a construction illustration showing a dryer assembly of yet another embodiment according to the present invention.

On the other hand, FIG. 11 is a construction illustration showing a dryer assembly of yet another embodiment according to the present invention. In the Figure, a dryer assembly 80 comprises: dryers 10A, 10B and 10C; and a microwave radiator 82 provided at a stage preceding the dryer 10A, wherein a microwave is irradiated on a to-be-dried object before the far infrared irradiation. The irradiation of a microwave is applied when a to-be-dried object contains much water. An irradiation time of the microwave is adjusted according to the content of water in a to-be-dried object. The dryers 10A, 10B and 10C used are the same as those described in any of the first to third embodiments.

It should be noted that a microwave radiator and an ultraviolet radiator are properly used according to a dry condition of a to-be-dried object.

Sixth Embodiment

The following Tables 2, 3, 4 and 5 show the parameters in each dryer including a temperature of the drying chamber, a surface temperature of the far infrared radiators, an irradiation time of far infrared radiation and a distance between the far infrared radiators and the to-be-dried object when the dryer assembly described in any of the first to third embodiments was used and good dry states of the to-be-dried objects were obtained.

TABLE 2

| | temperature in drying chamber (° C.) | | | distance | irridation time | board surface temperature |
|---|---|---|---|---|---|---|
| resin | 10A | 10B | 10C | (mm) | (sec) | (° C.) |
| epoxy | 100 | 120 | 100 | 50 | 35~45 | 100~160 |
| urethane | 100 | 112 ~118 | 100 | 50 | 35~45 | 120~130 |
| melamine | 96 | 130 | 124 | 50 | 120 | 175 |

In Table 2, to-be-dried objects that were prepared by coating aluminum boards 20 mm thick respectively with films made of epoxy resin, urethane resin and melamine resin, all 300 $\mu$m thick were irradiated with far infrared radiation of wavelengths in the range of from 3.98 to 4.63 $\mu$m corresponding to the maximum absorbances of the respective resins.

Surface temperatures of the aluminum boards which were not deformed and on which excellent dry conditions of the resins were obtained under the above described setting conditions of the parameters including a temperature in a drying chamber, a distance between surfaces of the far infrared radiators and board surface of the to-be-dried object and an irradiation time for each dryers were 100 to 160° C. in the case of epoxy resin, 120 to 130° C. in the case of urethane resin and 175° C. in the case of melamine resin.

TABLE 3

| | temperature in drying chamber (° C.) | | | distance | irradiation time | board surface temperature |
|---|---|---|---|---|---|---|
| resin | A | B | C | (mm) | (sec) | (° C.) |
| epoxy | 75 | 96 | 89 | 50 | 180 | 80 |
| urethane | 70 | 95 | 61 | 50 | 180 | 90 |
| lacquer | 70 | 85 | 63 | 50 | 30~90 | 55~77 |

In Table 3, to-be-dried objects that were prepared by coating 25 mm thick acrylic boards respectively with films made of epoxy resin, urethane resin and lacquer resin, all 300 $\mu$m thick, were irradiated with far infrared radiation of wavelengths in the range of from 3.98 to 4.63 $\mu$m corresponding to the maximum absorbances of the respective resins.

Surface temperatures of the acrylic boards which were not deformed and on which excellent dry conditions of the resins were obtained under the above described setting conditions of the parameters including a temperature in a drying chamber, a distance between surfaces of the far infrared radiators and the board surface of the to-be-dried object and an irradiation time were 80° C. in the case of epoxy resin, 90° C. in the case of urethane resin and 50 to 70° C. in the case of lacquer resin.

TABLE 4

| | temperature in drying chamber (° C.) | | | distance | irradiation time | board surface temperature |
|---|---|---|---|---|---|---|
| resin | A | B | C | (mm) | (sec) | (° C.) |
| phenol, epoxy | 103 ~ 110 | 106 ~ 112 | 93 ~ 94 | 40 | 120 ~ 180 | 120 ~ 145 |

In Table 4, to-be-dried objects that were prepared by coating 25 mm thick epoxy resin print boards with 300 $\mu$m thick films made of either epoxy resin or phenol resin, were irradiated with far infrared radiation of wavelengths in the range of from 3.58 to 6.46 $\mu$m corresponding to the maximum absorbance of the respective resins.

Surface temperatures of the print boards which were not deformed and on which excellent dry conditions of the resins were obtained under the above described setting conditions of the parameters including a temperature in a drying chamber, a distance between surfaces of the far infrared radiators and the board surface of the to-be-dried object and an irradiation time for each drying chamber were both 120 to 145° C. in the cases of epoxy resin and phenol resin.

TABLE 5

| | temperature in drying chamber | | distance | irradiation time | board surface temperature |
|---|---|---|---|---|---|
| resin | A | B | (mm) | (sec) | (° C.) |
| acrylic | 50 | 61 | 50 | 30 | 70~75 |

In Table 5, a to-be-dried object that was prepared by coating 25 mm thick polycarbonate resin boards with films made of 300 $\mu$m thick acrylic resin was irradiated with far infrared radiation of wavelengths in the range of from 3.98 to 4.63 $\mu$m corresponding to the maximum absorbance of the resin.

A surface temperature of the polycarbonate resin board which was not deformed and on which excellent dry conditions of the resin were obtained under the above described setting conditions of the parameters including a temperature in a drying chamber, a distance between surfaces of the far infrared radiators and the board surface of the to-be-dried object and an irradiation time were 70 to 75° C. in the case of acrylic resin.

In such a manner, an excellent dry condition is achieved on a board of a to-be-dried object when a surface temperature of the to-be-dried object is set to a predetermined temperature so that no deformation of the board of a to-be-dried object occurs by controlling at least one of the parameters including a temperature in a drying chamber, a surface temperature of the far infrared radiators, an irradiation time of far infrared radiation and a distance between far the infrared radiators and the to-be-dried object for each drying chamber.

Industrial Applicability of the Invention

As described above, the present invention is adapted for applications in drying to-be-dried objects such as electronic parts, automobile parts and food wherein far infrared radiators used are adjusted so as to radiate far infrared radiation of wavelength ranging from about 3 to about 6 $\mu$m, which corresponds to the maximum absorbance inherent in a to-be-dried object from a far infrared radiation layer provided on a metal surface. Especially, the present invention exerts a conspicuous effect on a to-be-dried object constituted of a thin film.

What is claimed is:

1. A dryer comprising:

a far infrared radiator that emits far infrared radiation for drying a to-be-dried object;

a drying chamber in which far infrared radiation emitted by the far infrared radiator is directed to the to-be-dried object to dry the to-be-dried object;

a plenum chamber for preparing a downflow of hot air toward the drying chamber;

a frame to which a plurality of the far infrared radiators are mounted and which is provided with an opening for jetting the hot air that flows down from the plenum chamber toward the drying chamber;

an elevating device for varying a distance between the to-be-dried object and the far infrared radiators;

a hot air closed circulation path for circulating the hot air that is heated up by heat generated from the far infrared radiators; and a control device for controlling a temperature in the drying chamber, an irradiation time of far infrared radiation, a surface temperature of the far infrared radiator and a distance between the far infrared radiator and the to-be-dried object.

2. A dryer comprising:

a far infrared radiator that emits far infrared radiation for drying a to-be-dried object;

a drying chamber in which far infrared radiation emitted by the far infrared radiator is directed to the to-be-dried object to dry the to-be-dried object;

a plenum chamber for preparing a downflow of hot air toward the drying chamber;

a frame to which a plurality of the far infrared radiators are mounted and which is provided with an opening for jetting the hot air that flows down from the plenum chamber toward the drying chamber;

an elevating device for moving the plenum chamber and the plurality of far infrared radiators, as one body, upward or downward;

a hot air closed circulation path for circulating the hot air that is heated up by heat generated from the far infrared radiators; and a control device for controlling a temperature in the drying chamber, an irradiation time of far infrared radiation, a surface temperature of the far infrared radiator and a distance between the far infrared radiator and the to-be-dried object.

3. A dryer comprising:

a far infrared radiator that emits far infrared radiation for drying a to-be-dried object;

a drying chamber in which far infrared radiation emitted by the far infrared radiator is directed to the to-be-dried object to dry the to-be-dried object;

a plenum chamber for preparing a downflow of hot air toward the drying chamber;

an enclosure for enclosing the plenum chamber and the far infrared radiator;

a frame to which a plurality of the far infrared radiators are mounted and which is provided with an opening for jetting the hot air that flows down from the plenum chamber toward the drying chamber;

an elevating device for varying a distance between the to-be-dried object and the far infrared radiators;

a hot air closed circulation path for circulating the hot air that is heated up by heat generated from the far infrared radiator; and a control device for controlling a temperature in the drying chamber, an irradiation time of far infrared radiation, a surface temperature of the far infrared radiator and a distance between the far infrared radiator and the to-be-dried object.

4. A dryer comprising:

a far infrared radiator that emits far infrared radiation for drying a to-be-dried object;

a drying chamber in which far infrared radiation emitted by the far infrared radiator is directed to the to-be-dried object to dry the to-be-dried object;

a reflecting plate disposed on one side of the to-be-dried object and an insulating material disposed on the other side, wherein the reflecting plate is opposed to the far infrared radiator;

an elevating device for varying a distance between the to-be-dried object and the far infrared radiators;

a first exhaust duct for discharging a gasified solvent from the to-be-dried object in the drying chamber to the atmosphere;

a second exhaust duct for discharging hot air that circulates in the drying chamber;

a hot air closed circulation path for circulating the hot air that is heated up by heat generated from the far infrared radiator; and a control device for controlling a temperature in the drying chamber, an irradiation time of far infrared radiation, a surface temperature of the far infrared radiator and a distance between the far infrared radiator and the to-be-dried object.

5. A dryer according to any one of claims 1 to 4, wherein the far infrared radiator includes: a far infrared radiation layer provided on a surface of a curved metal plate; a heating device for heating the metal plate; and a holding/shaping plate for holding the metal plate in a curved shape and/or making the metal plate assume a curved shape.

6. A dryer according to any one of claims 1 to 3, wherein the hot air closed circulation path is a closed path through which the hot air circulates from the drying chamber through the plenum chamber again to the drying chamber.

7. A dryer according to any one of claims 1 to 3, further comprising a gas molecule decomposition device that is provided in the hot air closed circulation path for cleaning the hot air that flows down from the plenum chamber.

8. A dryer according to claim 7, wherein the gas molecule decomposition device is located between the plenum chamber and the far infrared radiator at a site close to the far infrared radiators.

9. A dryer according to claim 7, wherein the gas molecule decomposition device has a radical reaction chamber in the enclosure for removing a gas molecule included in the hot air by a radical reaction.

10. A dryer according to claim 7, wherein the gas molecule decomposition device is located at a position downstream from the drying chamber.

11. A dryer according to claim 7, further comprising: a catalyst device and a filter device in the hot air closed circulation path in addition to the gas molecule decomposition device.

12. A dryer according to claim 11, wherein the filter device is provided in the plenum chamber.

13. A dryer according to claim 7, wherein the gas molecule decomposition device includes a heating device, a heat exchanger or a heat accumulator.

14. A dryer according to claim 13, wherein the heat accumulator has a structure in which a plurality of pipes made of a material with good heat conductivity are arranged at predetermined intervals.

15. A dryer according to any one of claims 1 to 4, wherein the far infrared radiator emits far infrared radiation from above and below the to-be-dried object.

16. A dryer according to any one of claims 1 to 4, wherein the far infrared radiator is arranged above or below the to-be-dried object and a reflecting plate that reflects far infrared radiation emitted from the far infrared radiator is disposed below or above the to-be-dried object.

17. A dryer according to any one of claims 1 to 4, wherein the drying chamber includes an enclosure comprising a reflecting plate disposed on one side of the to-be-dried object and an insulating material disposed on the other side of the to-be-dried object.

18. A dryer according to claim 17, wherein an interior of the enclosure constitutes a radical reaction chamber.

19. A dryer according to any one of claims 1 to 4, further comprising:

an exhaust path for discharging the hot air that is circulating in the hot air closed circulation path into the atmosphere; and a removal device provided in the exhaust path for preventing impurities in the hot air from being discharged into the atmosphere.

20. A dryer according to any one of claims 1 to 4, wherein the exhaust path comprises: a first exhaust duct for discharging a gasified solvent or the like from the to-be-dried object in the drying chamber into the atmosphere; and a second exhaust duct for discharging the hot air that is circulating in the drying chamber to the atmosphere.

21. A dryer according to any one of claims 1 to 4, wherein a surface temperature of the to-be-dried object is set to a predetermined temperature through control by the control device of at least one of the parameters including a temperature in the drying chamber, a surface temperature of the far infrared radiator, an irradiation time of far infrared radiation and distance between the far infrared radiator and the to-be-dried object.

22. A dryer according to any one of claims 1 to 4, wherein the control device controls at least one of parameters including a temperature in a drying chamber, a surface temperature of the far infrared radiator, an irradiation time of far infrared radiation and a distance between the far infrared radiator and the to-be-dried object so that no deformation of the to-be-dried object occurs.

23. A dryer according to claim 21, wherein the to-be-dried object includes a thin board made of acrylic resin and a surface temperature of the board is set in the range of from about 50° C. to about 90° C.

24. A dryer according to claim 21, wherein the to-be-dried object includes a thin board made of polycarbonate resin and a surface temperature of the board is set in the range of from about 70° C. to about 75° C.

25. A dryer according to claim 21, wherein the to-be-dried object includes a thin board made of epoxy resin and a surface temperature of the board is set in the range of from about 120° C. to about 145° C.

26. A dryer according to claim 21, wherein the to-be-dried object includes a thin board made of aluminum and a surface temperature of the board is set in the range of from about 100° C. to about 175° C.

27. A dryer assembly comprising a plurality of the dryers according to any one of claims 1 to 4, each as a unit, wherein parameters in each dryer including a temperature in a drying chamber, an irradiation time of far infrared radiation, a surface temperature of the far infrared radiator and a distance between the far infrared radiator and the to-be-dried object are independently controlled.

28. A dryer assembly according to claim 27, wherein at least one of the parameters in each dryer including a temperature in a drying chamber, an irradiation time of far infrared radiation, a surface temperature of the far infrared radiator and a distance between the far infrared radiators and the to-be-dried object is differently set from the other dryers.

29. A dryer assembly according to claim 27, wherein a temperature in a drying chamber is set to the lowest on the inlet side of the to-be-dried objects in a dryer.

30. A dryer assembly according to claim 27, wherein the dryer uses insulating material for a frame.

31. A dryer assembly according to any one of claims 1 to 4, comprising an ultraviolet radiator for irradiating the to-be-dried object with ultraviolet after the to-be-dried object is irradiated with far infrared radiation from the far infrared radiator.

32. A dryer assembly according to claim 31, wherein an irradiation dose of ultraviolet emitted from the ultraviolet radiator is in the range of from about 300 to about 600 $mJ/cm^2$.

33. A dryer assembly according to any one of claims 1 to 4, comprising an ultraviolet radiator for irradiating each to-be-dried object with ultraviolet before the to-be-dried object is irradiated with far infrared radiation from the far infrared radiator.

34. A dryer assembly comprising a plurality of the dryer according to any one of claims 1 to 4, comprising a microwave radiator for irradiating the to-be-dried object with microwave before the to-be-dried object is irradiated with far infrared radiation from the far infrared radiator.

35. A dryer assembly according to claim 27, further comprising transport means for transporting the to-be-dried object between the plurality of dryers, between the dryer an the ultraviolet radiator, or between the dryer and the microwave radiator.

36. A dryer assembly according to claim 35, wherein transport means is provided with transmission means for transmitting a microwave, far infrared radiation and ultraviolet.

37. A drying method comprising the steps of:

changing a wavelength range of far infrared radiation to a selected wavelength in order to supply far infrared radiation for drying a to-be-dried object by changing a surface temperature of a metal plate from which the far infrared radiation is emitted;

setting a surface temperature for setting a surface temperature of the metal plate of the to-be-dried object to a predetermined temperature by controlling a distance between a far infrared radiator and the to-be-dried object;

irradiating the to-be-dried object with far infrared radiation of the selected wavelength from the far infrared radiator; and supplying hot air heated up by using heat generated from the far infrared radiator to the to-be-dried object through a hot air closed circulation path.

38. A drying method comprising the steps of:

changing a wavelength range of far infrared radiation to a selected wavelength in order to supply far infrared radiation for drying a to-be-dried object by changing a surface temperature of a metal plate from which the far infrared radiation is emitted;

setting a surface temperature of the metal plate for setting a surface temperature of the to-be-dried object to a predetermined temperature by controlling a distance between a far infrared radiator and the to-be-dried object;

irradiating the to-be-dried object with far infrared radiation of the selected wavelength from the far infrared radiator;

supplying hot air heated up by using heat generated from the far infrared radiator to the to-be-dried object through a hot air closed circulation path; and irradiating the to-be-dried object with ultraviolet after the to-be-dried object is irradiated with far infrared radiation.

39. A drying method according to claim 38, including the step of emitting an irradiation dose of ultraviolet from the ultraviolet radiator is in the range of from about 300 to about 600 mJ/cm$^2$.

40. A drying method comprising the steps of:

irradiating a to-be-dried object with ultraviolet;

changing a wavelength range of far infrared radiation to a selected wavelength in order to supply far infrared radiation for drying the to-be-dried object by changing a surface temperature of a metal plate from which the far infrared radiation is emitted;

setting a surface temperature for setting a surface temperature of the metal plate of the to-be-dried object to a predetermined temperature by controlling a distance between a far infrared radiator and the to-be-dried object;

irradiating the to-be-dried object with far infrared radiation of the selected wavelength from the far infrared radiator; and supplying hot air heated up by using heat generated from the far infrared radiator to the to-be-dried object through a hot air closed circulation path.

41. A drying method comprising the steps of:

irradiating the to-be-dried object with a microwave;

changing a wavelength range of far infrared radiation to a selected wavelength in order to supply far infrared radiation for drying a to-be-dried object by changing a surface temperature of a metal plate from which the far infrared radiation is emitted;

setting a surface temperature for setting a surface temperature of the metal plate of the to-be-dried object to a predetermined temperature by controlling a distance between a far infrared radiator and the to-be-dried object;

irradiating the to-be-dried object with far infrared radiation of the selected wavelength from the far infrared radiator; and supplying hot air heated up by using heat generated from the far infrared radiator to the to-be-dried object through a hot air closed circulation path.

42. A drying method comprising the steps of:

changing a wavelength range of far infrared radiation to a selected wavelength in order to supply far infrared radiation for drying a to-be-dried object by changing a surface temperature of a metal plate from which the far infrared radiation is emitted;

setting a surface temperature of the metal plate for setting a surface temperature of the to-be-dried object to a predetermined temperature by controlling a distance between a far infrared radiator and the to-be-dried object;

supplying hot air heated up by using heat generated from the far infrared radiator to the to-be-dried object through a hot air closed circulation path;

irradiating the to-be-dried object with far infrared radiation of the selected wavelength from the far infrared radiator;

heating up hot air by using heat produced from the far infrared radiator, cleaning said heated hot air and supplying it to the to-be-dried object through a hot air closed circulation path.

43. A drying method according to any one of claims 37, 38, 40, 41 or 42, wherein the hot air supplied to the to-be-dried object is prepared from a plenum state as a downflow.

44. A, drying method according to any one of claims 37, 38, 40, 41 or 42, wherein far infrared radiation of a wavelength in the range of from about 3 $\mu$m to about 6 $\mu$m corresponding to the maximum absorbance inherent to the to-be-dried object is selected in the step of changing the wavelength range of far infrared radiation.

45. A drying method according to any one of claims 37, 38, 40 or 41, further comprising a step of cleaning for causing a radical reaction by gas decomposition of impurities in the hot air that circulates in the hot air closed circulation path.

46. A dryer according to claim 22, wherein the to-be-dried object includes a thin board made of acrylic resin and a surface temperature of the board is set in the range of from about 50° C. to about 90° C.

47. A dryer according to claim 22, wherein the to-be-dried object includes a thin board made of polycarbonate resin and a surface temperature of the board is set in the range of from about 70° C. to about 75° C.

48. A dryer according to claim 22, wherein the to-be-dried object includes a thin board made of epoxy resin and a surface temperature of the board is set in the range of from about 120° C. to about 145° C.

49. A dryer according to claim 22, wherein the to-be-dried object includes a thin board made of aluminum and a surface temperature of the board is set in the range of from about 100° C. to about 175° C.

50. A dryer assembly according to claim 31, further comprising transport means for transporting the to-be-dried object between the plurality of dryers, between the dryer an the ultraviolet radiator, or between the dryer and the microwave radiator.

51. A dryer assembly according to claim 50, wherein transport means is provided with transmission means for transmitting a microwave, far infrared radiation and ultraviolet.

52. A dryer assembly according to claim 33, further comprising transport means for transporting the to-be-dried object between the plurality of dryers, between the dryer an the ultraviolet radiator, or between the dryer and the microwave radiator.

53. A dryer assembly according to claim 52, wherein transport means is provided with transmission means for transmitting a microwave, far infrared radiation and ultraviolet.

54. A dryer assembly according to claim 33, further comprising transport means for transporting the to-be-dried object between the plurality of dryers, between the dryer an the ultraviolet radiator, or between the dryer and the microwave radiator.

55. A dryer assembly according to claim 54, wherein transport means is provided with transmission means for transmitting a microwave, far infrared radiation and ultraviolet.

* * * * *